US006533261B2

(12) United States Patent
Katou et al.

(10) Patent No.: US 6,533,261 B2
(45) Date of Patent: Mar. 18, 2003

(54) BILL RECEIVING/DISPENSING BOX

(75) Inventors: Riichi Katou, Nagoya (JP); Akira Nomiyama, Kashiwa (JP); Shinji Shibata, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 25 days.

(21) Appl. No.: 09/851,996

(22) Filed: May 10, 2001

(65) Prior Publication Data

US 2002/0014736 A1 Feb. 7, 2002

(30) Foreign Application Priority Data

May 19, 2000 (JP) ..... 2000-152745

(51) Int. Cl.[7] ..... B65H 5/22

(52) U.S. Cl. ..... 271/3.12; 271/149; 271/157; 271/163

(58) Field of Search ..... 271/3.12, 149, 271/157, 163

(56) References Cited

U.S. PATENT DOCUMENTS 5,100,022 A * 3/1992 Fukudome et al. ..... 271/149 X
5,104,109 A * 4/1992 Kubo
5,398,931 A * 3/1995 Tohgoh ..... 271/149 X
5,476,254 A * 12/1995 Golicz ..... 271/149 X
6,155,556 A * 12/2000 Lynch et al. ..... 271/149 X
6,168,151 B1 * 1/2001 Tsuchida ..... 271/157 X
6,334,610 B1 * 1/2002 Minamishin et al. ... 271/157 X

FOREIGN PATENT DOCUMENTS

JP 10-188074 A * 7/1998

OTHER PUBLICATIONS

Japanese patent unexamined publication No. 10–188074.

* cited by examiner

*Primary Examiner*—David H. Bollinger
(74) *Attorney, Agent, or Firm*—Antonelli, Terry, Stout & Kraus, LLP

(57) ABSTRACT

To provide actions for stably holding, storing and discharging bills in a state, in which many sheets of bills are stored or in a state, in which bills are folded or broken due to a condition of circulation or not only Japanese Yen bills but also foreign bills having different paper qualities are handled. Also, to provide a bill receiving/dispensing box with good operability involved when a staff charges bills in a storage section. The bill receiving/dispensing box comprises a stacking/separating mechanism, a push plate drive mechanism, a device for shifting a position of a separation/stack guide interlockingly with the push plate drive mechanism, a driving force connecting/disconnecting device for the push plate and lower bill support members, a push plate locking device, and a containable-type stand capable of inclining the bill receiving/dispensing box with the stacking/separating mechanism on a lower side.

21 Claims, 8 Drawing Sheets

CONTROL BLOCK DIAGRAM FOR AUTOMATIC TELLER MACHINE 101

CONTROL BLOCK DIAGRAM FOR BILL RECEIVING / DISPENSING MACHINE

BILL RECEIVING/DISPENSING BOX

BACKGROUND OF THE INVENTION

The invention relates to a bill receiving/dispensing machine (for example, an ATM used by banking organs or the like), from and to which general users make use of cards, passbooks, or the like to directly receive and pay cash, and more particularly, to a bill receiving/dispensing box used for return-type bill receiving/dispensing machines, in which received bills are used as bills being dispensed.

Conventionally, in bill receiving/dispensing machines for return-type ATMs used in banking organs or the like, vertical-type bill receiving/dispensing boxes are commonly employed to be placed at the services of storage of received bills, delivery of bills being paid, automatic recovery of bills from the machine, automatic recovery of bills from the machine, automatic charging of bills to the machine, automatic inspection for determining cash remaining in the machine, or the like. Meanwhile, there has been proposed a system, in which horizontal-type bill receiving/dispensing boxes are stacked in a plurality of stages on account of an advantage that an entire installation can be composed of a relatively simple conveying system and bill receiving/dispensing boxes can be increased in number without a change is installation area.

For example, Japanese Patent Unexamined Publication No. 18807/1998 shows a construction of a bill receiving/dispensing machine, which employs horizontal bill receiving/dispensing boxes.

SUMMARY OF THE INVENTION

As ATMs or the like have spread, there has been an increasing demand for bill receiving/dispensing machines, which are smaller in size, lower in cost, and easier of use while ensuring conventional functions and performance. Meanwhile, as foreign bills have been increasingly accepted in Japan and there has been an increasing demand for bill receiving/dispensing machines in foreign countries, an installation capable of handling not only Japanese Yen bills but also foreign bills has been demanded.

For the purposes of simplification of a mechanism for smaller size and lower cost and enhancement of reliability and operability, the following points must be adequately taken into consideration with respect to bill receiving/dispensing boxes, which are mounted on the above-described bill receiving/dispensing machines. It is necessary for bill receiving/dispensing boxes to store and discharge bills in a state, in which as many as 2000 to 3000 bills are stored and store and discharge bent or broken bills generated during circulation and foreign bills having different paper quality. For such purposes, it is important (1) to stably hold various, many bills stored in an aligned state, (2) to surely conduct the stored bills to a separation mechanism section at the time of separating operation and let out the same, (3) to move bills having been stored in a direction away from a stack mechanism section at the time of stacking operation to ensure a storage space for bills to be stacked to align and stack bills, and (4) to enable a staff to align and set bills in a state, in which bills neither fall nor incline, when the staff charges bills in a storage section.

Meanwhile, with the above-described prior art, the reliability of machine, there has not been taken into consideration reliability of an installation, in particular, reliability when bills act when a large number of bills are handled and under unfavorable conditions in terms of circulation.

It is an object of the invention to provide a bill receiving/dispensing box capable of performing stable separating and stacking actions for a large number of bills and for bills under unfavorable condition due to circulation, and having a good operability, with which a staff charges bills in a storage section.

To attain the above object, the bill receiving/dispensing box in accordance with the invention comprises a stacking/separating mechanism connected to a bill conveying path outside of the bill receiving/dispensing box, and for storing bills in the bill receiving/dispensing box and separating bills from the bill receiving/dispensing box, and a push plate for supporting a side of stacked bills opposite to the stacking/separating mechanism, and for driving bills toward the stacking/separating mechanism when bill are to be separated, and keeping bills away from the stacking/separating mechanism to drive the same toward a storage space formed when bills are to be stacked. Also, the bill receiving/dispensing box comprises a bill guide adapted to abut against a side of stacked bills toward the stacking/separating mechanism, and for moving bills to a position, where a bill is conducted to the stacking/separating mechanism, when bills are to be separated, and keeping bills away from the stacking/separating mechanism to move the same to a position, where a storage space is formed, when bills are to be stacked. Further, the bill receiving/dispensing box employs a push plate and bill guide interlocking mechanism adapted to interlock with the push plate, which moves stacked bills toward and against the stacking/separating mechanism, when bills are to be separated, to move the bill guide to a position where a bill is conducted to the stacking/separating mechanism, and adapted to interlockingly drive the push plate and the bill guide so as to interlock with the push plate, which keeps stacked bills away from the stacking/separating mechanism to drive the same to a position where a storage space is formed, when bills are to be separated.

DESCRIPTION OF THE EMBODIMENTS

An embodiment of the invention will now be described in detail with reference to the accompanying drawings.

Figure 1:
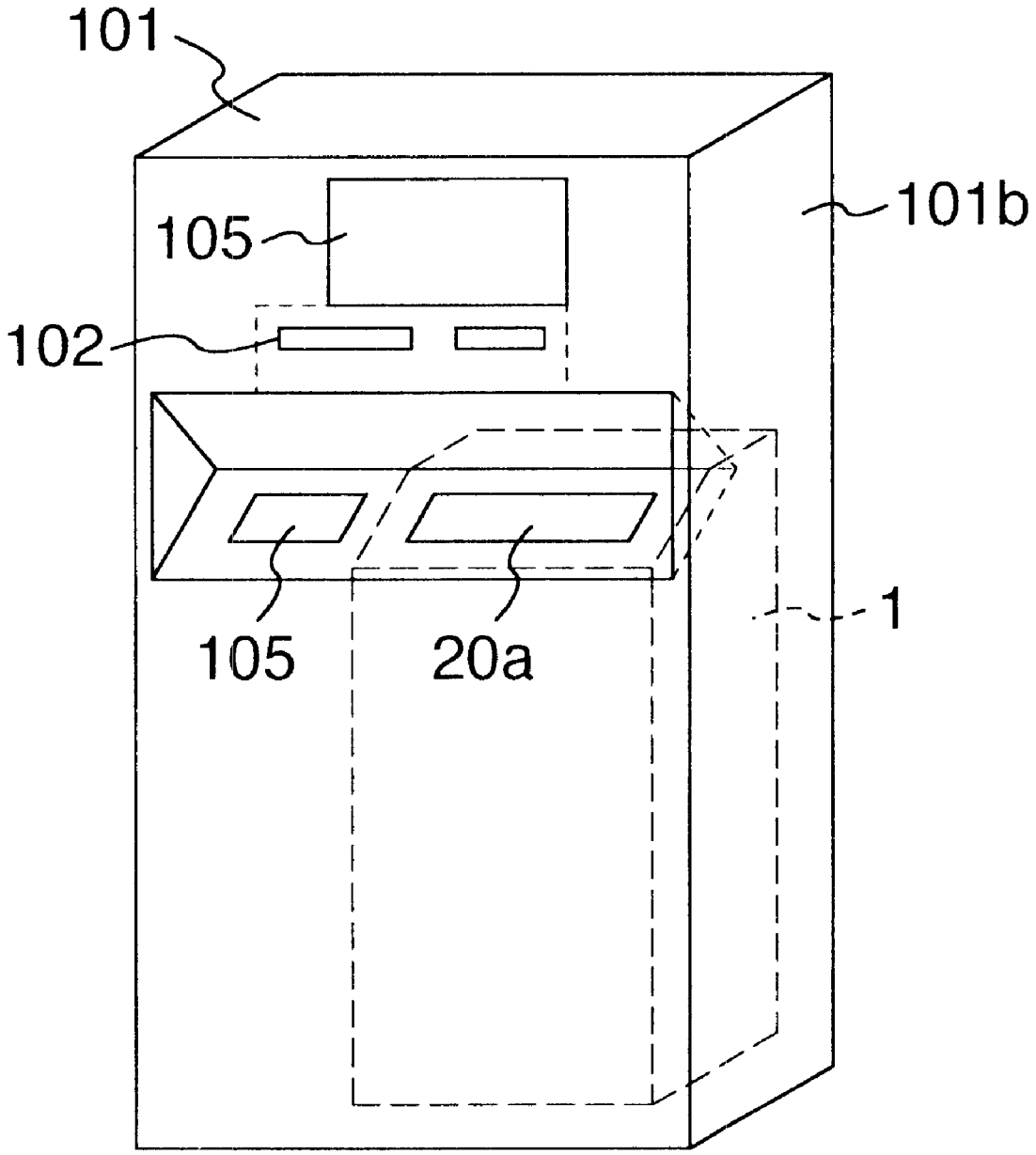
FIG. 1 is a schematic perspective view showing an automatic teller machine mounting thereon a bill receiving/dispensing mechanism.

FIG. 1 is a perspective view showing an external appearance of an automatic teller machine, to which the invention is applied. An automatic teller machine 101 comprises in an upper and interior part thereof a card/detail sheet processing mechanism 102 and a customer operation section 105. Also, the automatic teller machine 101 further comprises in a lower and interior part thereof a bill receiving/dispensing machine 1 for processing bills, and a bill slot 20*a* on a front. This automatic teller machine 101 can perform processing for deposit, payment, transfer, or the like by a customer with a card, a bill, and a detail sheet.

Figure 2:
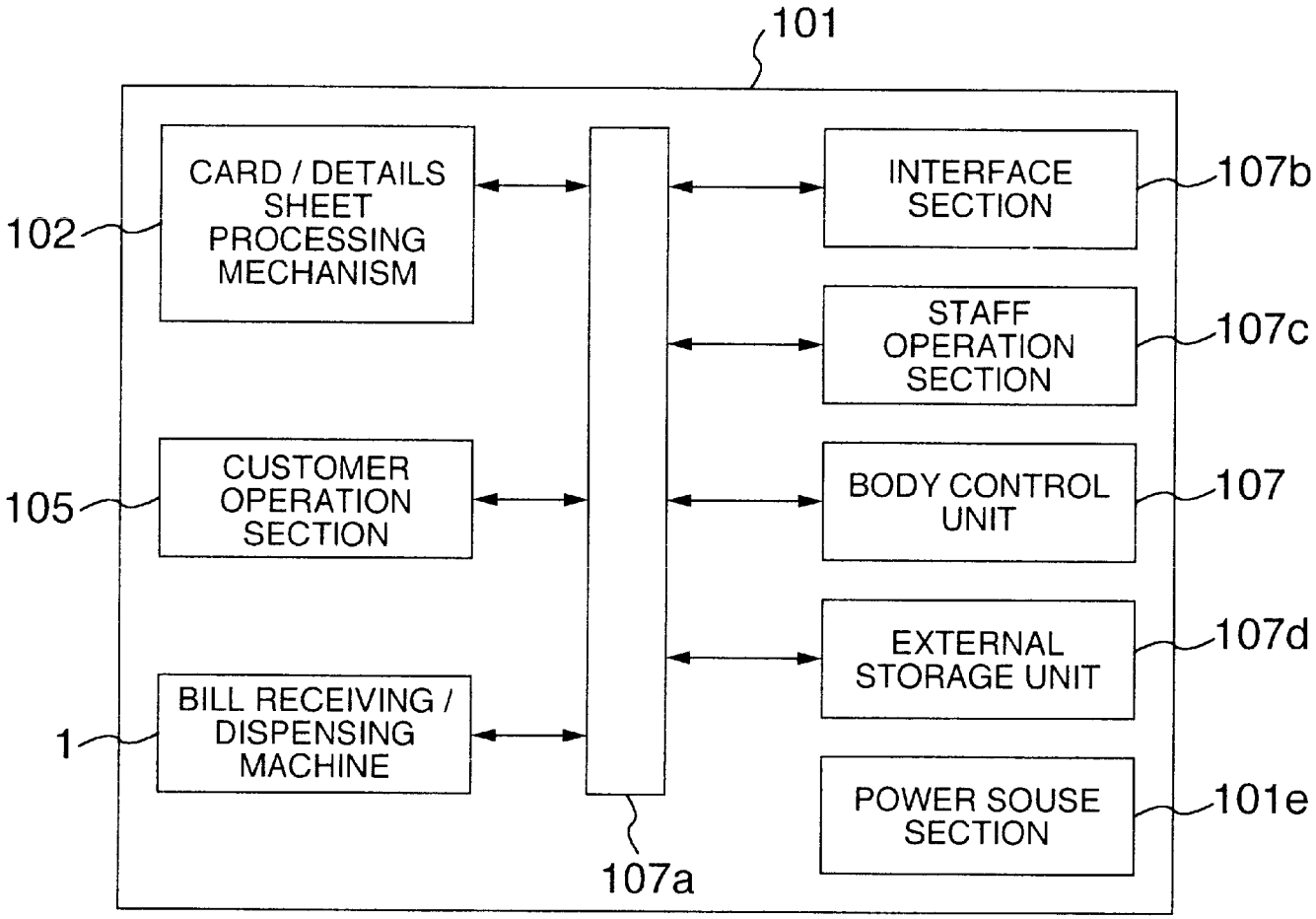
FIG. 2 is a block diagram showing the control relationship of an automatic teller machine.

FIG. 2 is a control block diagram showing the control relationship in this machine. As described above, the card/detail sheet processing mechanism 102, the bill receiving/dispensing machine 1, and the customer operation section 105, which are contained in the automatic teller machine 101, are connected to a body control unit 107 to perform necessary operations under the control of the body control unit 107.

Figure 3:
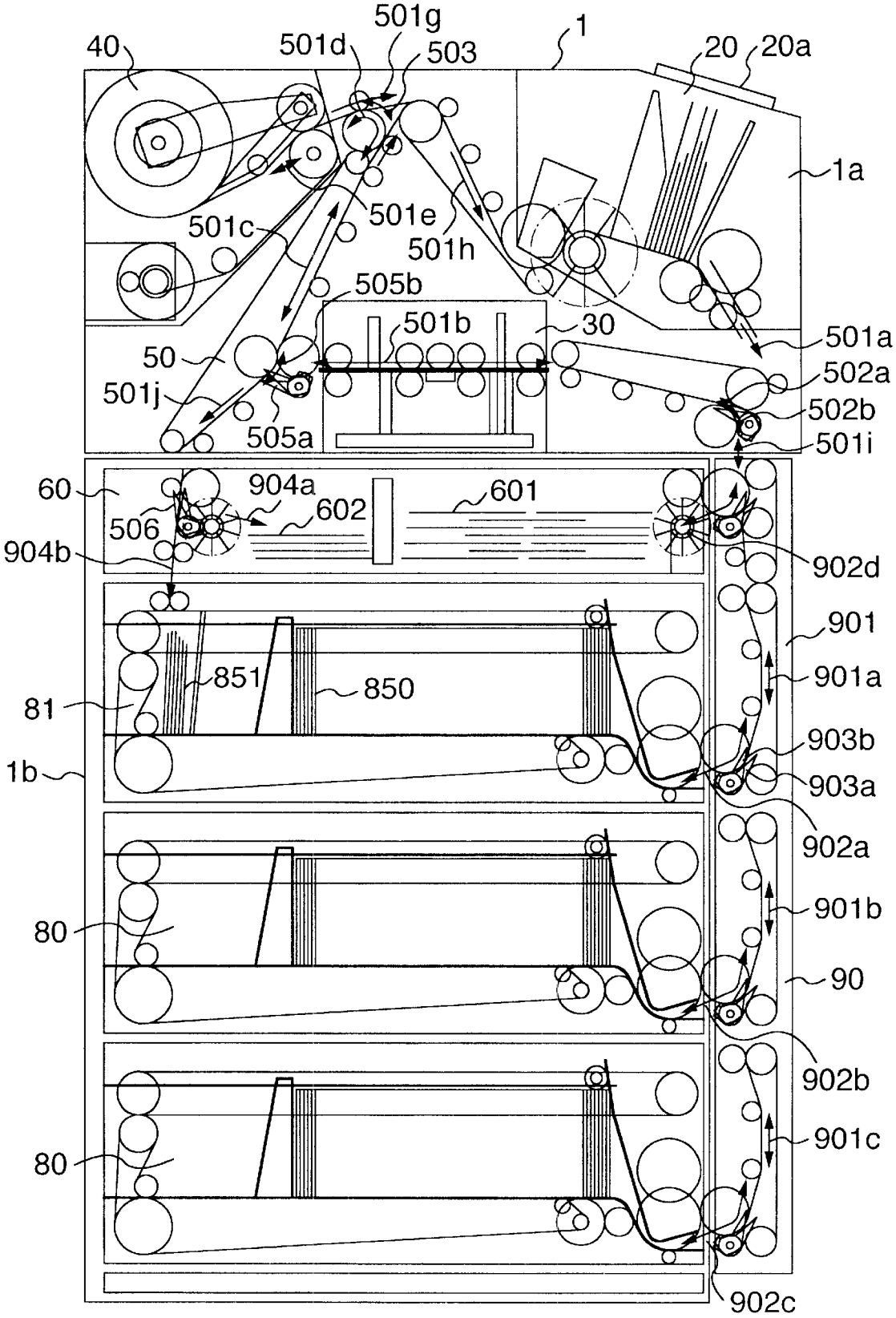
FIG. 3 is a side view showing an embodiment of a bill receiving/dispensing mechanism.

FIG. 3 is a side view showing the construction of the bill receiving/dispensing machine 1 according to the invention, which is provided in the automatic teller machine shown in FIG. 1. The bill receiving/dispensing machine 1 comprises a money deposit and payment port 20, through which a customer charges and takes out bills, a bill discriminating section 30 for discriminating bills, a temporary storage section 40 for temporarily storing deposited bills until a transaction is concluded, two recycle boxes 80 for storing bills, for which a transaction is concluded, at the time of reception and for placing these bills at the service of payment, a reject box 60 for storing bills not placed at the service of reception and payment, a charge/recovery box 81 for storing bills being replenished into the recycle boxes 80 and bills being recovered from the recycle boxes 80, a bill conveying path 50, along which bills are conveyed to the money deposit and payment port 20, the temporary storage box 40, the reject box 60, the recycle boxes 80 and the charge/recovery box 81 through the bill discriminating section 30, and a control unit (not shown).

Hereupon, the recycle boxes 80 and the charge/recovery box 81 constitute a bill receiving/dispensing box, to which the invention is applied, each having a storage space for about 2500 bills and housing a stacking/separating mechanism. The charge/recovery box 81 differs from the recycle box 80 in that a charge reject section described later is included.

Figure 4:
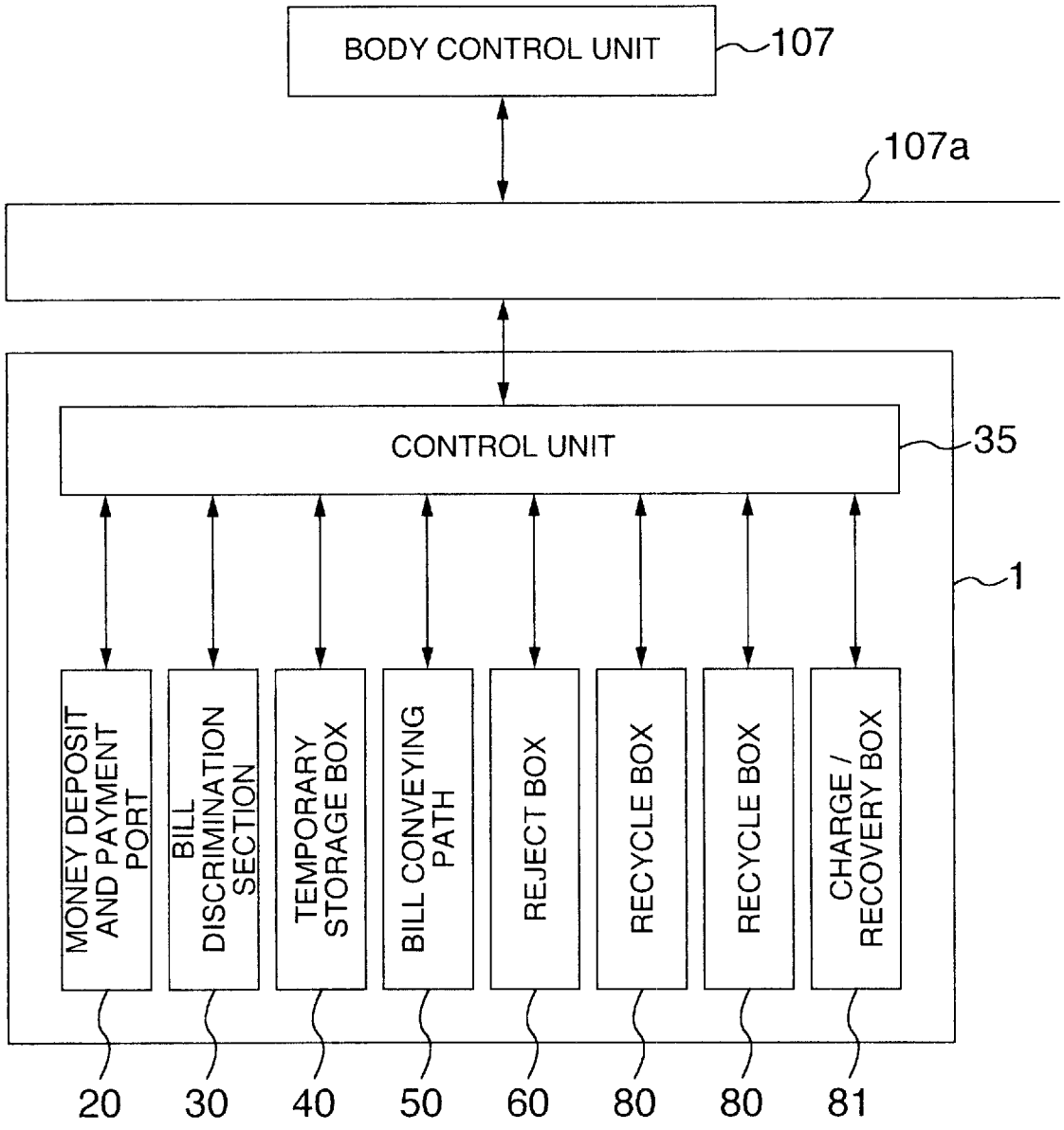
FIG. 4 is a block diagram showing the control relationship of a bill receiving/dispensing mechanism.

As shown in FIG. 4, a control unit 35 is connected to the body control unit 107 to control the bill receiving/dispensing machine 1 in accordance with a command from the body control unit 107 and detection of a state of the bill receiving/dispensing machine 1, and also forwards the state of the bill receiving/dispensing machine 1 to the body control unit 107 at need. Within the bill receiving/dispensing machine 1, the control unit is connected to drive motors, electromagnetic solenoids and sensors for respective units (the money deposit and payment port 20, the bill discriminating section 30, the temporary storage box 40, the bill conveying path 50, the reject box 60, the recycle boxes 80, and the charge/recovery box 81) to drivingly control actuators according to a transaction while monitoring a state by means of the sensors.

As shown in FIG. 3, a conveying path mechanism for the bill receiving/dispensing machine 1 is composed of an upper bill conveying mechanism la comprising the money deposit and payment port 20, the bill discriminating section 30, the temporary storage box 40 and the bill conveying path 50, and a lower bill conveying mechanism 1*b* comprising the reject box 60, the recycle boxes 80, the charge/recovery box 81 and an openable conveying path 90 arranged in front of the respective storage boxes.

The bill receiving/dispensing machine 1 constructed in the above manner is mounted inside a lower portion of the automatic teller machine 101 as shown in FIG. 1. It is possible to employ a front side operation type or a back side operation type depending upon the type of the machine, and the construction correspondingly varies somewhat. As shown in FIG. 5A, the front side operation type machine, on a front side of which a staff performs operation, is constructed such that a front door 101*c* can be opened and closed, and when, as shown in the figure, the front door 101*c* is opened and the conveying path 90 of the bill receiving/dispensing machine 1 is opened, storage boxes each provided with a handle appear. The staff can pull out the respective storage boxes with the handle to perform operations such as replenishment and recovery of bills, and other maintenance work.

Figure 5B:
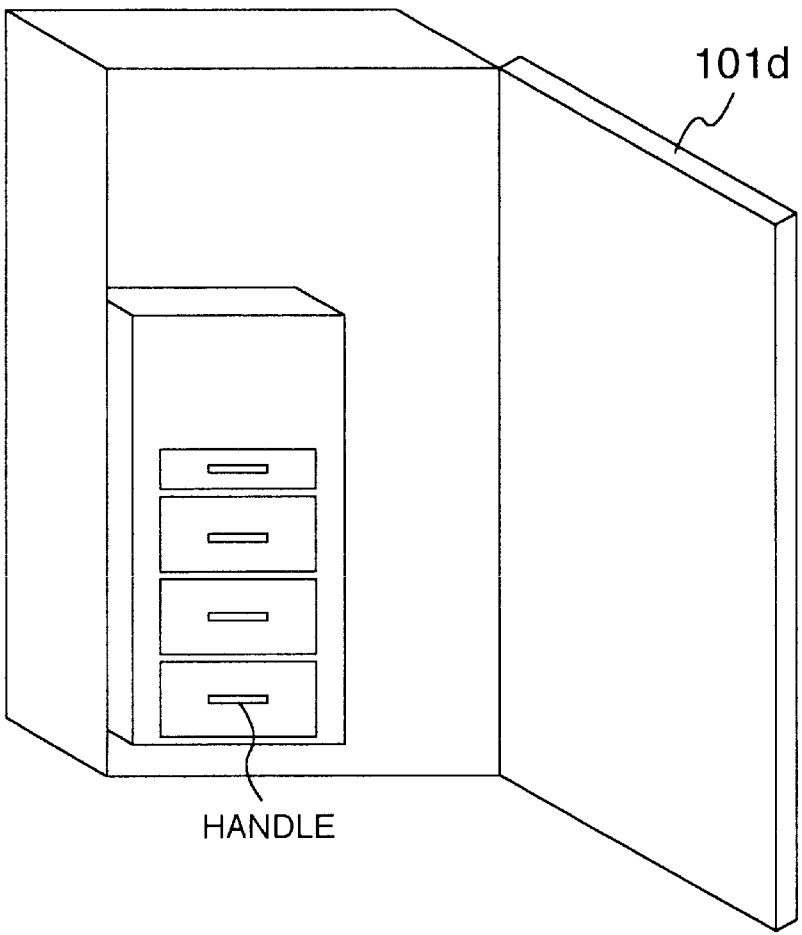
FIG. 5B is a view showing how to operate the automatic teller machine shown in FIG. 1.
Figure 5A:
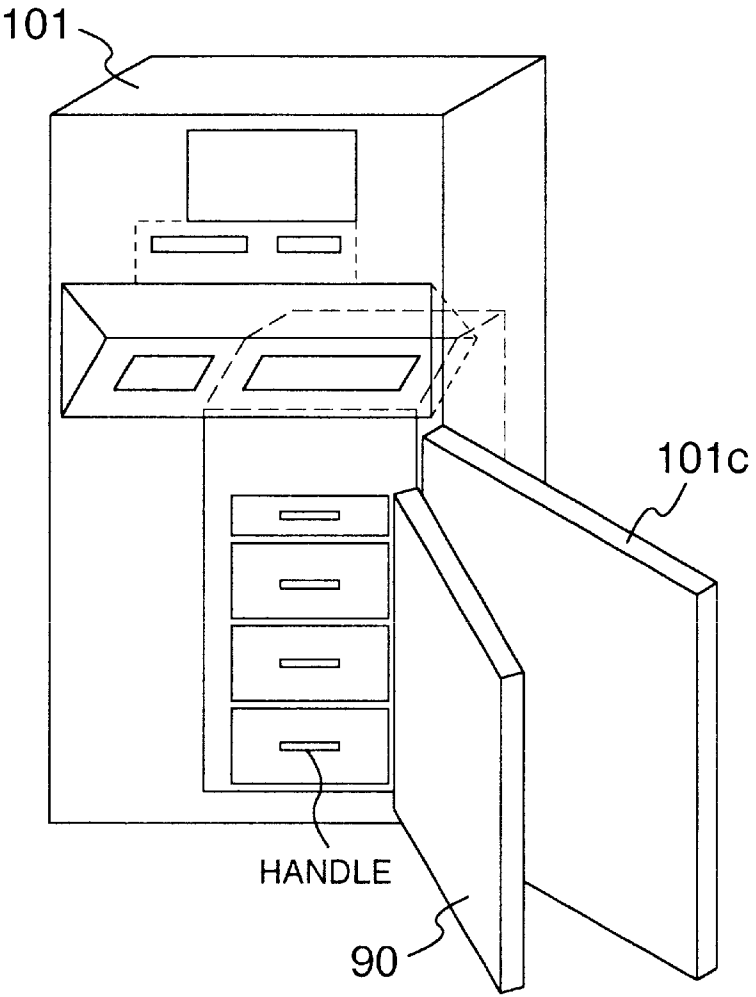
FIG. 5A is a view showing how to operate the automatic teller machine shown in FIG. 1.

Meanwhile, as shown in FIG. 5B, the back side operation type machine, on a back side of which a staff performs operation, is constructed such that a back door 101*d* can be opened and closed, and when, as shown in the figure, the back door 101*d* is opened, the storage boxes each provided with a handle appear. The staff can pull out the respective storage boxes with the handle to perform operation.

Storage portions of the respective units (the money deposit and payment port 20, the bill discriminating section 30, the temporary storage box 40, the reject box 60, the recycle boxes 80, and the charge/recovery box 81) ensure a short side dimension of about 100 mm and a long side dimension of about 200 mm for bills to be capable of handling not only Japanese Yen bills but also foreign bills having different dimensions from those of Japanese Yen bills, and a conveying section (the bill discriminating section 3, the temporary storage box 4, and the bill conveying path 5) ensures a width of about 220 mm.

An explanation will be given below to an action of the bill receiving/dispensing mechanism 1. At the time of deposit transaction, an action of the mechanism includes a deposited money counting action for counting bills deposited by a customer, and a deposited money storage action for storing bills in individual storage boxes every denomination after a customer has confirmed the counted amount of money. In the case where cancellation is chosen after a customer inputs confirmation, the mechanism performs a cancellation/return action.

At the deposited money counting action, bills charged into the money deposit and payment port 20 are separated one by one to be passed along arrows 501*a* and 501*b* to the bill discriminating section 30, where denomination and authenticity of bills are discriminated. The bills having been discriminated are conveyed in directions along arrows 501*d* and 501*e* from arrow 501*c* by switching of a switching gate 503 to be temporarily stored in the temporary storage box 40. A bill or bills, which the bill discriminating section 30 could not discriminate or a bill or bills, of which reception is rejected due to a tilt or abnormal spacings between bills, are not taken into the temporary storage box 40, but are passed along arrow 501*h* by switching of the switching gate 503 to be stored in the money deposit and payment port 20 to be returned to the customer.

At the time of reception and storage of money, a bill or bills are fed from the temporary storage box 40 in the order reverse to and in a direction reverse to those in the deposited money counting action, forwarded along the arrows 501*e* and 501*d* to be conveyed to 501*c* and 501*b* to be passed through the bill discriminating section 30 to go by way of 501*i* and 901*a* by switching of a switching gate 502 to a direction shown by 502*b* to be stored in specified storage boxes by switching of a switching gate 903 of either of the recycle box 80 and the reject box 60 to a direction shown by 903*b*. At the time of cancellation and return, a bill or bills are conveyed along arrows 501*e*, 501*g* and 501*h* by switching of the switching gate 503 to be stored in the money deposit and payment port 20 to be returned to the customer.

At the time of payment transaction, bills are taken out by predetermined numbers from boxes every denomination of the recycle boxes 80 to go by way of arrows 901*c, b*, and *a* and 501I to be discriminated in terms of denomination by the bill discriminating section 30 to be branched at the switching gate 503 to be stored in the money deposit and payment port 20 to be paid to the customer. In the case where rejection of money payment is caused due to impossible discrimination at the bill discriminating section 30, a bill or bills thus rejected are stored in the temporary storage box 40 by switching of the switching gate 503 in the same manner as at the time of deposited money counting action. Bills making up the balance are additionally taken out from the recycle box 80.

Also, with this embodiment, the charge/recovery box 81 can be used to perform charging and recovery actions between the charge/recovery box 81 and the recycle box 80 through the medium of the temporary storage box 40. In the charge operation, a staff does not individually set bills, desired to be set every denomination, in the charge/recycle boxes 80 but collectively sets them in the charge/recovery box 81, and allows them to be automatically stored in the charge/recycle boxes 80 in the machine. First, in the charge counting action, bills taken out from the charge/recovery box 81 pass though 901*a*, 501*i*, and 501*b* to be discriminated in terms of denomination by the bill discriminating section 30, and are temporarily stored in the temporary storage box 40. Then, in the charge storage action, bills are successively discharged from the temporary storage box 40 to go by way of the same bill conveying path in the reverse direction, and are stored in a specified recycle box 80 every denomination. When the number of bills collectively stored in the charge/recovery box 81 is more than those storable in the temporary storage box 40, the charge counting action and the charge storage action are repeated. Also, a bill or bills, of which denomination cannot be discriminated and charging of which is rejected, go by way of 501*j* and 904*b* upon the switching of a switching gate 505 in a direction indicated by 505*b* in the figure and the switching of a switching gate 506 to be stored in a charge reject storage portion rearward in the charge/recovery box 81.

In the recovery action, when the recycle box 80 becomes full or so, a staff does not individually remove bills from the recycle box 80, but a predetermined number of bills are automatically recovered from the recycle box 80 to the charge/recovery box 81 to be stored therein. In this action, bills move via a route reverse to that for the charge action, and so bills from the recycle box 80 are stored temporarily in the temporary storage box 40, and then are recovered from the temporary storage box 40 to the charge/recovery box 81.

An explanation will be given below in detail to the construction and action of the recycle boxes (bill receiving/dispensing boxes) 80 applied to the bill receiving/dispensing mechanism 1 with reference to FIGS. 6 to 10.

Figure 6:
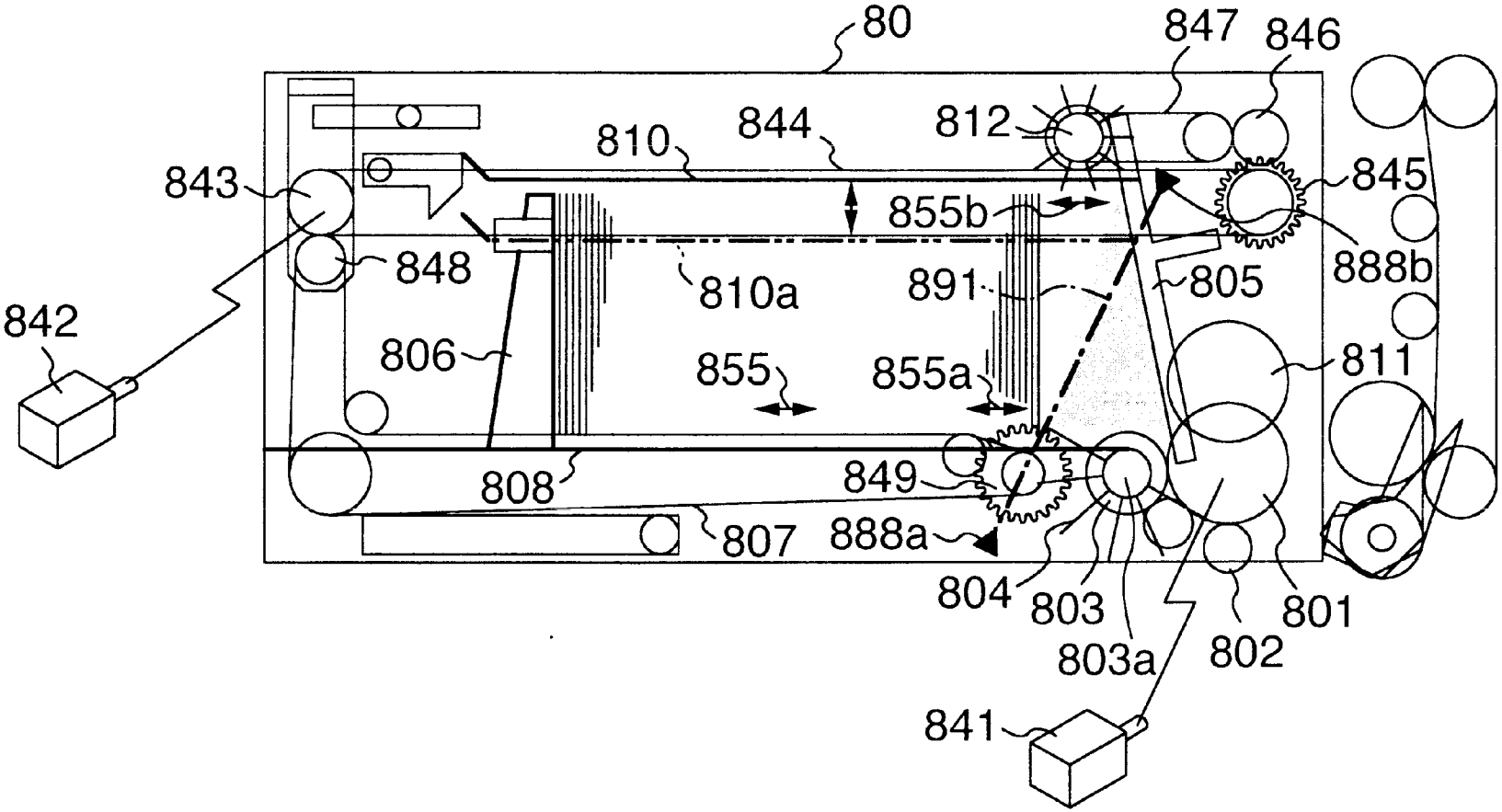
FIG. 6 is a side view showing a recycle box (at the time of separating operation)
Figure 7:
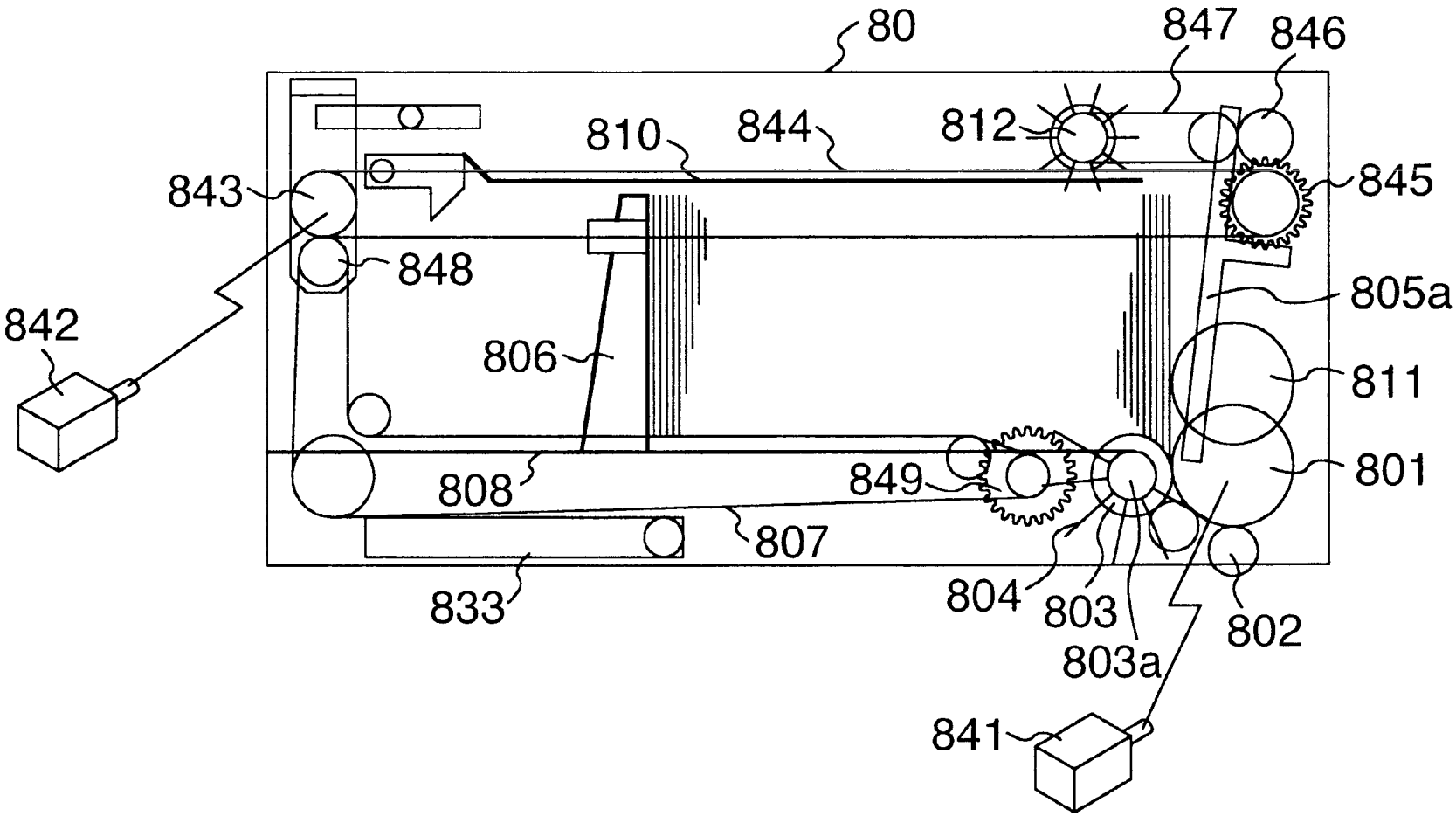
FIG. 7 is a side view showing a recycle box (at the time of stacking operation)
Figure 8:
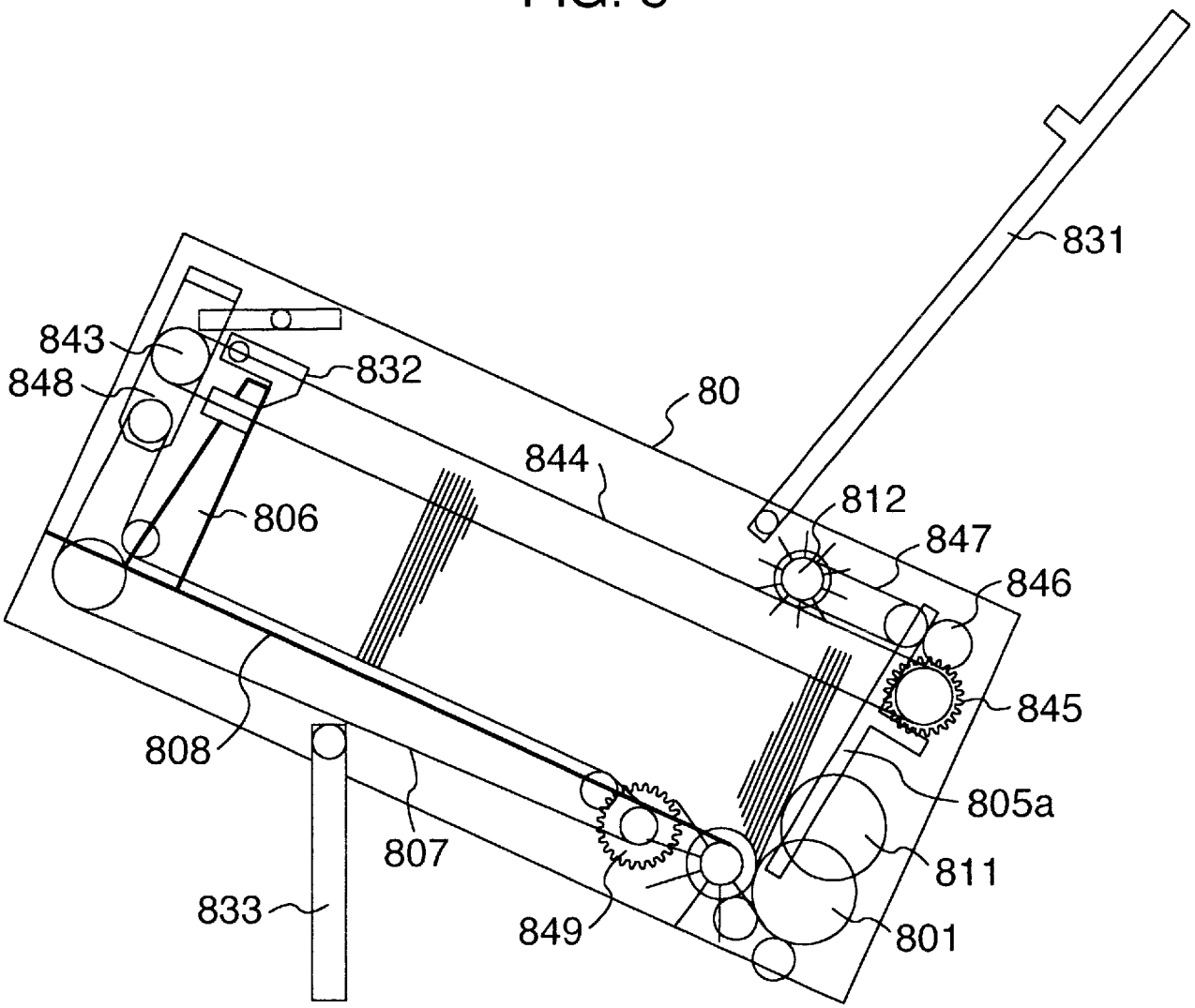
FIG. 8 is a side view showing a recycle box (when a staff operates).

The recycle boxes 80 are capable of storing bills and separating and taking out them, and the bill receiving/dispensing mechanism 1 shown in FIG. 3 is provided with two recycle boxes 80, construction of which is shown in FIGS. 6 to 8. FIG. 6 shows a state in the bill storing action, FIG. 7 showing a state in the bill separating action, and FIG. 8 showing a state when a recycle box 80 is dismounted from the bill receiving/dispensing mechanism 1 to remove bills from the storage section and when bills are charged in the storage section (that is, a staff operates).

The recycle box 80 is mainly composed of a stack feed roller 801 and a pickup roller 811, which are rotatingly driven by a drive source 841 (a feed motor or a step motor) mounted outside of the box through the medium of gears, a backup roller 802 for driven rotation, a gate roller 803 for rotation in a direction of storage and non-rotation in a taking-out direction, a brush roller 804 coaxial with the gate roller 803 and provided with a flexible pushing-in member in a radial manner, and a separation/stack guide 805 (bill guide) movable at the time of separation and stacking, as well as bill stacking and separating mechanisms.

Other layout constructions of the recycle box 80 will be explained. Bills are stored in a storage space enclosed by a bottom plate 808, a push plate 806, a bottom flat belt 807 suspended so as to support lower faces of bills at a higher level than the bottom plate 808, and the separation/stack guide 805. Further, upper and lower ends of bills having been stored are supported by upper bill support members 812 disposed in the vicinity of the separation/stack guide 805 in the upper part of the storage section so as to be associated with the upper part of the separation/stack guide 805, and lower bill support members (not shown, but are present near the reference numeral 849), disposed in the vicinity of the gate roller 803 disposed in the lower part of the storage section.

The push plate 806, the bottom flat belt 807, the upper bill support members 812, the lower bill support members, and the separation/stack guide 805, which move in the storage space, are connected to a shaft 843 from a drive source 842 (push plate motor: step motor) mounted outside of the box, and constitute a push plate motor driving mechanism driven via gears, belts, or the like. The push plate 806 is fixed to a timing belt 844 supported on the sides of the storage space of the recycle box 80 in a longitudinal direction to be driven in a direction indicated by arrow 855, that is, in a longitudinal direction of the recycle box 80 (lateral direction in the figure). The upper bill support members 812 are rotatingly driven in a direction indicated by arrow 855*b* via a gear 846 and a timing belt 847 by a shaft 845 on the front side of the timing belt 844. The separation/stack guide 805 is swingably supported on a rotating shaft of the stack feed roller 801 to be moved between positions shown in FIGS. 6 and 7 via a gear having a torque limiter inserted thereinto and provided on the shaft 845 on the front side of the timing belt 844. The bottom flat belt 807 is driven by a driving force of the drive source 842 transmitted from the shaft 843 to a shaft 848 via a gear. The lower bill support members are constructed integral with a pulley 849 on the front side of the bottom flat belt 807, and is rotatingly driven in a direction indicated by arrow 855*a*.

The upper bill support members 812 supporting upper ends of bills are disposed at two locations in a direction of bill long side, and the lower bill support members supporting lower ends of bills are disposed at four locations in the same way, the both members being acceleratedly driven interlocking with the push plate 806 and the bottom flat belt 807 by the push plate motor 842 in the bill stacking direction or in the non-stacking (separating) direction.

A detailed explanation will be given to an action of the above-described recycle boxes 80.

In the storing action shown in FIG. 6, the switching gate 903 shown in FIG. 3 is switched as at 903*b* in the figure. Thereby, a bill or bills stored in the recycle boxes 80 are branched as shown by arrow 902*b* from the bill conveying path (arrows 901*b, c*). Then, the bill is fed between the rotating stack feed roller 801 and the backup roller 802, shown in FIG. 6. Further, the bill is fed between the stack feed roller 801 and the gate roller 803 rotating in the stacking direction. The bill having been fed between the stack feed roller 801 and the gate roller 803 is stored along the separation/stack guide 805 to be stored in a substantially triangular-shaped stack space 891. Lower ends of the stored bills are scraped in the stack direction by the rotating brush roller 804, whereby interference thereof with succeeding bills is prevented. Further, upper and lower ends of the stored bills are supported by the upper bill support members 812 and the lower bill support members, and the bills are scraped toward the push plate 806. Thereby, bills stored successively in the recycle box 80 from the stack feed roller 801 and the gate roller 803 are maintained in upright position. In addition, the lower bill support members may be in the form of a belt rather than a pulley.

The push plate 806 and the bottom flat belt 807 move together in the storage space, and are controlled in movement in a direction, in which bills stored are spaced away from the separation/stack guide 805, so as to avoid interference between the stored bills and bills being conveyed and entering, as bills stored increase. Transmission sensors (remaining bill detecting sensors) 888*a* and 888*b* are used to monitor an increase in the number of stored bills, and the above control of movement is stopped when continuous dark is detected for a predetermined period of time or longer. At this time, the upper bill support members 812 rotate in a clockwise direction and the lower bill support members rotate in a counterclockwise direction to support upper and lower ends of bills having been stored, thus maintaining the bills in upright position while pushing the bills toward the push plate 806.

As described above, the separation/stack guide 805 is swingably supported on the rotating shaft of the stack feed roller 801, and receives a driving force via the gear 846, in which a torque limiter is inserted, from the shaft 845 on the front side of the timing belt 844. Thereby, the position shown in FIG. 6 is maintained, and the substantially triangular-shaped stack space 891 shown in FIG. 6 is surely formed to allow the stored bills to be surely supported by the above-described upper bill support members 812 and lower bill support members.

When the bottom flat belt 807 is driven together with the push plate 806, a connection shaft (not shown) rotates, so that the moving speed (arrow 855*a*) of the lower bill support members is increased in proportion to the radius ratio of the pulley 849 relative to the moving speed (arrow 855) of the bottom flat belt 807. Likewise, the moving speed (arrow 855*b*) of the upper bill support members 812 is also increased by a mechanism (not shown) relative to the moving speed of the bottom flat belt 807. In this manner, the upper bill support members 812 and the lower bill support members are moved at a speed about 1.2 to 1.3 times the speed of the bottom flat belt 807, that is, the push plate 806 when bills are stored, whereby a compressive force acts on bill being stored, and a continuous storing action is made possible in the stable upright position. Also, this compression action can prevent surplus bulking of stacked bills to increase the storage capacity of bills.

An explanation will be given to the separating action (a state from FIG. 6 to FIG. 7) shown in FIG. 7. As described above, the separation/stack guide 805 is swingably supported on the rotating shaft of the stack feed roller 801. Therefore, the separation/stack guide 805 receives a driving force via the gear 846, in which a torque limiter is inserted, from the shaft 845 on the front side of the timing belt 844, and thus moves to a position shown in FIG. 7. The push plate 806 and the bottom flat belt 807 move together in the storage space to allow the stored bills to move so that bills being taken-out apply a predetermined pressing force on the pickup roller 811. Bills pressed against the pickup roller 811 are forwarded by the rotating stack feed roller 801, and are conveyed one by one in a direction indicated by arrow 902*b* in FIG. 3 while the gate roller 803 not rotating in the take-out direction (by the action of a one-way clutch housed therein) is preventing two bills from being fed at a time. At this time, bills are switched in the direction of the switching gate 903*b* to be conveyed in the direction indicated by arrows 901*b* and 901*c*.

Further, after the separating action, the separation/stack guide 805 in the next storing action (a state from that shown in FIG. 7 to that shown in FIG. 6) is swingably supported on the rotating shaft of the stack feed roller 801, and receives a driving force via the gear 846, in which a torque limiter is inserted, from the shaft 845 on the front side of the timing belt 844. Thereby, the separation/stack guide 805 is moved to a position shown in FIG. 6. The push plate 806 and the bottom flat belt 807 are moved together in the storage space by a drive source (not shown) outside the machine, the transmission sensors (remaining bill detecting sensors) 888*a* and 888*b* are used to monitor, and the substantially triangular-shaped stack space 891 shown in FIG. 6 is formed to make the next storing action possible.

In the above-described action effected by a push plate driving mechanism, only the push plate 806 suffices to be movable, for example, in the case where a volume of bills being stored is as small as about 500 sheets, or in the case where bills are new having been short in circulation. However, in the case where a volume of bills is as large as 2000 to 3000 sheets as in this embodiment, and not only new bills but also bills, which have been long in circulation to have wrinkles and bends, low stiffness, and are hard to be maintained in upright position when stacked, due to lack of firmness, are handled, the supporting action provided by the bottom flat belt 807, the upper bill support members 812, the lower bill support members, and the separation/stack guide 805 becomes effective.

FIG. 8 is a view showing a state, in which a staff manipulates the recycle box 80. As shown in the figure, a stand 833 mounted containably on the floor surface of the recycle box 80 is pulled out to make the recycle box oblique at about 20 degrees with respect to a floor surface (not shown). A top cover 831 made integral with a ceiling plate 810 of the storage section in the recycle box 80 is opened as shown in FIG. 8. Then, the push plate 806 is retracted manually to the rearmost position in the storage section to be locked by a push plate lock 832. At this time, connection with the push plate motor 842 shown in FIGS. 6 and 7 is released to allow the push plate 806 to be moved easily. Interlocking with putting the top cover 831 in an opened state, the shaft 848 moves downward to be released from connection with the shaft 843. Therefore, even if the push plate 806 were moved, the bottom flat belt 807 and the lower bill support members 849 would not be driven. Also, Interlocking with putting the top cover 831 in an opened state, connection between the gear 846 and the timing belt 847 is released, so that even if the push plate 806 were moved, the upper bill support members 812 would not be driven.

Thereby, even in the case where bills as many as 2000 to 3000 sheets are to be handled, the bills can be maintained in alignment without falling. An operator can surely operate the push plate 806 to perform charging and removing actions with both hands and with light operating forces.

Next, an explanation will be given to alignment and storage dimensions in a long side direction of small-size bills.

The recycle box 80 can be provided to be made low in cost by a design conformed to largest-size bills being handled and by common use for various denominations of small-size bills. However, as described above, foreign bills are greatly varied in bill size in both long and short side directions depending on denomination, and so in order to ensure a stable continuous bill storing action, addition of the following mechanisms to the recycle box 80 is further effective. A first mechanism is a stopper 810 (roof plate) for restricting upper ends, that is, positions in the short side direction of bill being stored, the stopper being designed to be vertically adjustable together with the upper bill support members 812, as shown in FIG. 6, in accordance with denomination (size of short side) and being adjusted to a position indicated by two-dot chain line 810*a*. Thereby, unevenness in the short side direction can be eliminated.

A second mechanism is capable of adjusting side wall positions of the storage space in conformity with the long side direction of bills being stored. Thereby, unevenness in the long side direction can be eliminated.

Also, mediums handled by the mechanism of the invention may include sheets such as securities, lottery cards, tickets, checks, cards and so on in addition to bills.

As described above, according to the invention, even in the case where a volume of bills is as large as 2000 to 3000 sheets, and not only new bills but also bills, which have been long in circulation to have wrinkles and bends, low stiffness, and are hard to be maintained in upright position when stacked, due to lack of firmness, are handled, (1) it is possible to stably hold such bills in aligned position. Also, (2) it is possible in the separating action to surely conduct stored bills to the separation mechanism section and to separate and take out bills one by one. Also, (3) it is possible in the stacking action to move bills, having been stored, in a direction away from the stacking mechanism section to ensure a storage space for bills being stacked to align and stack the bills. Also, (4) when a staff charges bills in the storage section, it is possible to set the bills in an aligned manner without falling or tilting. Thereby, it is possible to provide a highly reliable bill receiving/dispensing mechanism with good operability.

What is claimed is:

1. A bill receiving/dispensing box for storing bills in a stacked manner, comprising:

a stacking/separating mechanism for storing bills in said bill receiving/dispensing box and separating the bills therefrom;

a push plate for supporting bills stacked on an opposite side to said stacking/separating mechanism, driving bills toward the stacking/separating mechanism when bills are to be separated, and keeping bills away from said stacking/separating mechanism and driving them toward a side, on which a storage space is formed, when bills are to be stacked;

a bill guide adapted to abut against a side of stacked bills toward the stacking/separating mechanism, and for moving bills to a position, where bills are conducted to said stacking/separating mechanism, when bills are to be separated, and keeping bills away from said stacking/separating mechanism to move them to a position, where a storage space is formed, when bills are to be stacked; and a drive mechanism for driving said push plate and said bill guide interlockingly with each other so that when bills are to be separated, said push plate moves stacked bills in a direction, in which stacked bills are pushed against said stacking/separating mechanism, and, interlocking with said push plate, said bill guide is moved to a position where bills are conducted to said stacking/separating mechanism, and so that when bills are to be stacked, said push plate keeps stacked bills away from said stacking/separating mechanism to move them to a side where a storage space is formed, and, interlocking with said push plate, said bill guide keeps stacked bills away from said stacking/separating mechanism to move them to a position at which the storage space is formed.

2. The bill receiving/dispensing box according to claim 1, wherein when bills are to be separated, bills pushed against said stacking/separating mechanism are driven by said stacking/separating mechanism to be taken out to a conveying path outside of said bill receiving/dispensing box.

3. The bill receiving/dispensing box according to claim 1, wherein when bills are to be stacked, bills conveyed from said stacking/separating mechanism are conveyed toward said storage space thus formed.

4. The bill receiving/dispensing box according to claim 1, wherein said stacking/separating mechanism comprises a stack feed roller and a pickup roller, which are rotatingly driven, a backup roller rotated drivenly, a gate roller adapted to rotate only in a direction, in which bills are to be stored, and a brush roller disposed coaxial with said gate roller and provided with radially extending bill pushing-in members.

5. The bill receiving/dispensing box according to claim 4, wherein when bills are to be separated, bills pushed against said pickup roller are forwarded upon rotation of said pickup roller and said stack feed roller, and are conveyed to a conveying path outside of said bill receiving/dispensing box while said gate roller prevents two bills from being forwarded at a time.

6. The bill receiving/dispensing box according to claim 4, wherein when bills are to be stacked, a bill conveyed between said stack feed roller and said backup roller is forwarded into said storage space formed upon rotation of said stack feed roller and said gate roller.

7. The bill receiving/dispensing box according to claim 6, wherein said brush roller scrapes lower ends of bills stored in a direction, in which stacking is effected.

8. The bill receiving/dispensing box according to claim 1, further comprising a separate drive mechanism for driving said stacking/separating mechanism, said drive mechanism and said separate drive mechanism being independent from each other.

9. A bill receiving/dispensing machine for receiving and dispensing bills, comprising:

a money deposit and payment port, through which a customer charges or take out a bill or bills;

a discriminating section for discriminating bills; and a bill receiving/dispensing box or boxes for horizontally stacking and storing bills in upright position, said bill receiving/dispensing box comprising a stacking/separating mechanism connected to a bill conveying path outside of said bill receiving/dispensing box, and for storing bills in said bill receiving/dispensing box and separating bills from said bill receiving/dispensing box, a push plate adapted to support stacked bills on a side opposite to said stacking/separating mechanism and move in response to the action of bills, a bill guide adapted to abut against a side of stacked bills toward the stacking/separating mechanism and to move in response to the action of bills to thereby form a storage space for storing therein bills, upper bill support members for supporting upper portions of stacked bills, lower bill support members for supporting lower portions of stacked bills, and a first drive section for driving said stacking/separating mechanism and a second driving section for driving said push plate, said bill guide, said upper bill support members, and said lower bill support members, in response to the separating action of bills or the stacking action of bills.

10. The bill receiving/dispensing machine according to claim 9, wherein when a bill or bills charged through said money deposit and payment port are to be stored in said bill receiving/dispensing box, said second driving section keeps said push plate away from said stacking/separating mechanism to move the same to a side on which a storage space is formed.

11. The bill receiving/dispensing machine according to claim 10, wherein said upper bill support members and said lower bill support members are caused by said second driving section to support upper and lower portions of bills having been stored, respectively, to ensure a storage space.

12. The bill receiving/dispensing machine according to claim 9, wherein when a bill or bills charged through said money deposit and payment port are to be stored in said bill receiving/dispensing box, said upper bill support members and said lower bill support members are caused by said second driving section to support upper and lower portions of stored bills, respectively, to ensure a storage space.

13. The bill receiving/dispensing machine according to claim 9, wherein when a bill or bills charged through said money deposit and payment port are to be stored in said bill receiving/dispensing box, said bill guide keeps bills away from said stacking/separating mechanism to form a storage space.

14. The bill receiving/dispensing machine according to claim 9, wherein when a bill or bills are conveyed from said bill receiving/dispensing boxes to said money deposit and payment port, said push plate is caused by said second driving section to move and push stored bills in a direction toward the stacking/separating mechanism side.

15. The bill receiving/dispensing machine according to claim 9, wherein when a bill or bills in said bill receiving/dispensing boxes are dispensed through said money deposit and payment port, said bill guide moves stored bills to a position where a bill or bills are conducted to said stacking/separating mechanism.

16. The bill receiving/dispensing machine according to claim 9, wherein when a bill or bills in said bill receiving/dispensing boxes are dispensed through said money deposit and payment port, said upper bill support members and said lower bill support members support stored bills on a side of the stacking/separating mechanism.

17. The bill receiving/dispensing machine according to claim 9, wherein said stacking/separating mechanism comprises a rotating stack feed roller, a gate roller adapted to rotate only in one direction, and a pickup roller for taking out stored bills.

18. The bill receiving/dispensing machine according to claim 17, wherein when a bill or bills are conveyed from said bill receiving/dispensing boxes to said money deposit and payment port, said stack feed roller and said gate roller rotate to convey bills to a storage space formed in said bill receiving/dispensing box.

19. The bill receiving/dispensing machine according to claim 17, wherein when bills stored in said bill receiving/dispensing box are dispensed through said money and payment port, a bill put in contact with said pickup roller is taken out toward said stack feed roller, said gate roller prevents two bills from being forwarded at a time, and said stack feed roller conveys the taken-out bill to a conveying path outside said bill receiving/dispensing box.

20. A bill receiving/dispensing box for storing bills, comprising:

a stacking/separating mechanism for storing and separating bills;

a movable push plate adapted to support bills stacked on a side opposite to said stacking/separating mechanism;

push plate locking means capable of fixing said push plate at a position on a side opposite to said stacking/separating mechanism in said bill receiving/dispensing box when stored bills are taken out or when bills are charged in a storage section; and a containable stand capable of obliquely positioning said bill receiving/dispensing box.

21. The bill receiving/dispensing box according to claim 20, further comprising a openable top cover, and wherein when a staff opens said top cover, connection between said push plate and other elements moving interlocking therewith is released.

* * * * *